US009068452B2

(12) United States Patent
Wang et al.

(10) Patent No.: US 9,068,452 B2
(45) Date of Patent: Jun. 30, 2015

(54) COAL CAVING CYCLE

(75) Inventors: Maohu Matthew Wang, Sydney (AU); Steven Chandler, Sydney (AU)

(73) Assignee: Yancoal Technology Development PTY Ltd, Sydney, NSW (AU)

( * ) Notice: Subject to any disclaimer, the term of this patent is extended or adjusted under 35 U.S.C. 154(b) by 271 days.

(21) Appl. No.: 13/818,059

(22) PCT Filed: Mar. 19, 2012

(86) PCT No.: PCT/AU2012/000286

§ 371 (c)(1),
(2), (4) Date: Feb. 20, 2013

(87) PCT Pub. No.: WO2013/010206

PCT Pub. Date: Jan. 24, 2013

(65) Prior Publication Data

US 2013/0187436 A1 Jul. 25, 2013

(30) Foreign Application Priority Data

Jul. 15, 2011 (AU) ..... 2011902843

(51) Int. Cl.

| | |
|---|---|
| ***E21D 23/12*** | (2006.01) |
| ***E21C 27/20*** | (2006.01) |
| ***E21C 41/18*** | (2006.01) |
| ***E21C 35/24*** | (2006.01) |
| ***E21D 23/04*** | (2006.01) |
| ***E21D 23/06*** | (2006.01) |
| *E21D 23/18* | (2006.01) |

(52) U.S. Cl.

CPC ..... *E21C 27/20* (2013.01); *E21D 23/18* (2013.01); *E21D 23/12* (2013.01); *E21C 41/18* (2013.01); *E21C 35/24* (2013.01); *E21D 23/0454* (2013.01); *E21D 23/066* (2013.01)

(58) Field of Classification Search

CPC ..... E21D 23/12; E21D 23/14; E21C 41/18; E21C 25/68

USPC ..... 299/1.6, 1.7

See application file for complete search history.

(56) References Cited

U.S. PATENT DOCUMENTS

| | | | | |
|---|---|---|---|---|
| 4,065,929 | A | 1/1978 | Simpson | |
| 6,848,748 | B2 * | 2/2005 | Paschedag et al. | 299/33 |
| 2011/0006586 | A1 * | 1/2011 | Holme | 299/33 |

FOREIGN PATENT DOCUMENTS

| | | | |
|---|---|---|---|
| AU | 2005242116 | A1 | 6/2006 |
| DE | 2808487 | A1 * | 9/1979 |

OTHER PUBLICATIONS

International Search Report and Written Opinion of PCT/AU2012/000286 mailed on Apr. 24, 2012, 9 pages.

* cited by examiner

*Primary Examiner* — David Bagnell
*Assistant Examiner* — Michael Goodwin
(74) *Attorney, Agent, or Firm* — Kilpatrick Townsend & Stockton LLP

(57) ABSTRACT

A coal caving system (1) including a plurality of shields (3) with canopies (6) which are selectively operated to allow coal to cave onto a rear conveyor (37). In one aspect, the invention provides a shield control method including controlling the shield (3) to automatically open a door (6) associated with a rear canopy of the shield (3) responsive to a position of a shearer of the system.

10 Claims, 13 Drawing Sheets

COAL CAVING CYCLE

RELATED APPLICATION

This application claims priority from Australian Patent Application No. 2011902843, the contents of which are incorporated by reference.

FIELD OF THE INVENTION

The present invention relates to the operation of a caving system such as, for example, a long wall top coal caving (LTCC) system.

BACKGROUND OF THE INVENTION

An LTCC system has a tailgate, a main gate and a cutter that travels between the main gate and tail gate, to cut coal from the long wall. The system also includes front and rear armored conveyors that travel beneath overhead shields, from the tailgate end, to deliver coal to a beam stage loader positioned adjacent the main gate. Each conveyor runs along a respective front or rear pan line and is driven by two motors, one at the tail gate end and one at the main gate end. The front conveyor carries coal cut by the cutter while the rear conveyor carries caved coal.

The shields protect the various components of the system and support the roof of the mine. The shields provide a continuous protective canopy over the length of the long wall, which may be up to 300 meters in length. Special buttress, gate and transition shields are provided toward each end of the system. The remaining run of face shields allow for caving, which is a distinguishing feature of the LTCC system. In particular, the shields are provided with a caving canopy and a slide door. The canopy can be lowered and the slide retracted to allow coal to cave onto the rear conveyor, after which the canopy can be returned to its original position.

With existing LTCC systems, the caving operation is conducted manually, on each individual shield in turn. After each cutting cycle, the shields are moved forward, the caving is then completed and the rear pan line is pulled forward in line with the shields, ready for the next cutting cycle. As may be appreciated, the entire process is relatively time consuming and the output of coal during the caving cycle varies dramatically. The volume of coal output from the caving cycle is also considerably less overall compared to the coal extracted during the cutting cycle.

OBJECT OF THE INVENTION

It is an object of the invention to provide an improved coal extraction technique.

SUMMARY OF THE INVENTION

In one broad aspect, there is provided a shield control method including controlling a shield of a coal caving system to automatically open a door associated with a rear canopy of the shield to allow coal to cave onto a conveyor.

Preferably, the door is opened responsive to a position of a shearer of the system.

Preferably, doors of adjacent shields along a length of the system are sequentially opened and closed during a first cycle which follows a first pass of the shearer.

Preferably, the rear canopy is retracted to increase caving.

Preferably, a rear canopy and door of one or more adjacent shields are sequenced to open and close along the length of the system so that groups of adjacent shields simultaneously undergo a coal caving operation so as to allow an increased amount of coal to cave onto the conveyor.

Preferably, the caving operation propagates along the length of the system by virtue of selective opening and closing of the shields.

Preferably, the caving operation is performed during a second cycle, ahead of a second pass of the shearer.

In accordance with one broad aspect, there is provided a method of operating a long wall top coal caving system which includes a front and rear conveyor extending beneath shields which include canopies and associated caving doors, wherein the caving doors are sequenced to automatically open in a first cycle to regulate limited caving onto the rear conveyor.

Preferably, groups of canopies are opened selectively during a second cycle to allow increased caving onto the rear conveyor.

Preferably, the system includes a shearer which cuts a web distance into the long wall to deliver coal to the front conveyor, wherein the shearer is operated to cut a web in two passes, the first pass cutting a greater portion of the web and the second pass cutting the remaining portion of the web.

Preferably, the first cycle of the caving follows the first pass of the shearer.

Preferably, the second pass of the shearer follows the second cycle.

In another broad aspect, there is provided a long wall top caving system including a front and rear conveyor extending beneath shields which include canopies that are operable to allow caving onto the rear conveyor, the system further including a controller to automatically open the canopies in accordance with the above described method.

In another broad aspect, there is provided a controller for a long wall top coal caving system, the caving system including a front and rear conveyor extending beneath shields which include canopies, wherein the controller includes a processor configured to automatically to open the canopies to allow caving onto the rear conveyor.

Preferably, the controller is in communication with a plurality of sensors from one or more components of the long wall top coal caving system, wherein the processor is configured to:

receive one or more feedback signals indicative of operation of the one or more components;

determine, based on the one or more feedback signals, if the canopies are to be opened; and in response to a positive determination, actuate one or more drives associated with the canopies to allow caving onto the rear conveyor.

Preferably, the caving system includes a shearer, wherein the one or more sensors include a shear position to detect a position of the shearer and to transfer a position signal indicative of a position of the shearer to the controller, wherein the processor is configured to compare the position of the shearer against one or more position thresholds, stored in memory of the controller, to determine if one or more of the canopies require opening.

Preferably, the processor is configured to determine, based on the position of the shearer, if the shearer has passed one or more of the canopies which are open, wherein in response, the processor actuates a drive of the canopy to close the respective one or more canopies accordingly.

Preferably, in response to determining the position of the shearer, the controller actuates one or more conveyor drives to cause displacement of a respective one or more portions of the front and/or rear conveyor toward a long wall which the shearer is cutting.

Preferably, each canopy includes a flipper actuated by a flipper drive which is urged against the long wall in a deployed position, wherein in response to determining that the position of the shearer satisfies a first position threshold, the flipper drive is actuated by the processor to move the flipper to a retracted position.

Preferably, in response to determining that the position of the shearer satisfies a second position threshold, the flipper drive is actuated by the processor to move the flipper to the redeployed position and urged against the long wall.

Preferably, the processor is configured to actuate a plurality of canopy drives associated with a rear canopy and door of one or more adjacent shields which are sequenced to open and close along the length of the caving system so that groups of adjacent shields simultaneously undergo a coal caving operation so as to allow an increased amount of coal to cave onto the conveyor.

BRIEF DESCRIPTION OF THE DRAWINGS

The invention is more fully described, by way of non-limiting example only, with reference to the accompanying drawings, in which.

DETAILED DESCRIPTION OF THE INVENTION

Figure 1:
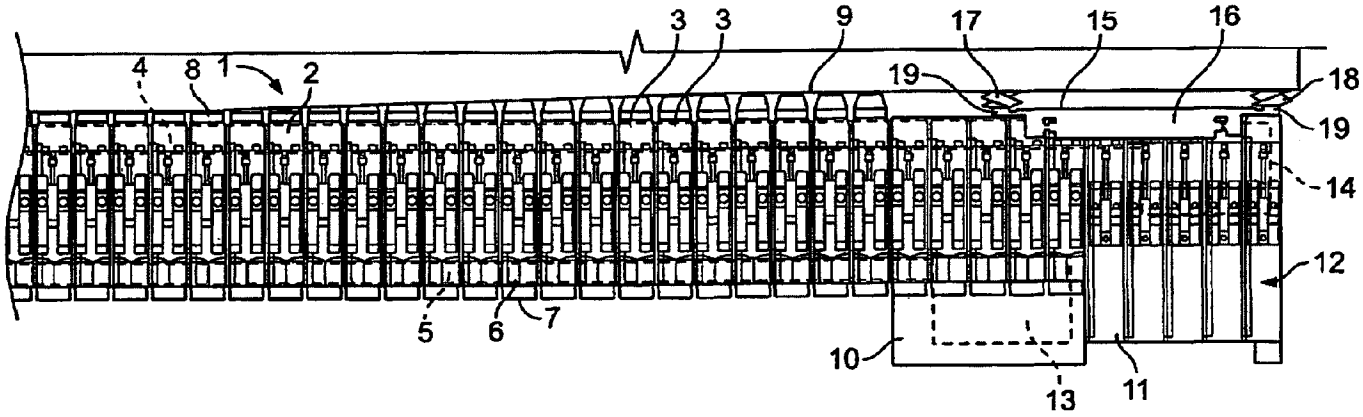
FIG. 1 is a schematic view of a long wall top coal caving (LTCC) system with a shearer in a first position at a tail gate end.

Referring firstly to FIG. 1, a long wall top coal caving (LTCC) system 1 is shown as including a coal extraction arm 2 with a plurality of run of face shields 3 that extend over a front pan line 4 and a rear pan line 5 that in turn support front and rear conveyors (not shown for clarity). The shields 3 each have rear canopies 6, associated slide doors 7 and flippers 8 to abut the coal face of long wall 9.

A transition shield 10 and special end gate shields 11 are located adjacent a tail gate (TG) 12 of the extraction arm 2 and cover a rear tail gate drive 13 and front tail gate drive 14, respectively.

A shearer 15 is also located adjacent the tail gate end 12. The shearer 15 includes a shearer arm 16 which supports two cutter drums 17, 18 on respective ranging arms 19.

Figure 2:
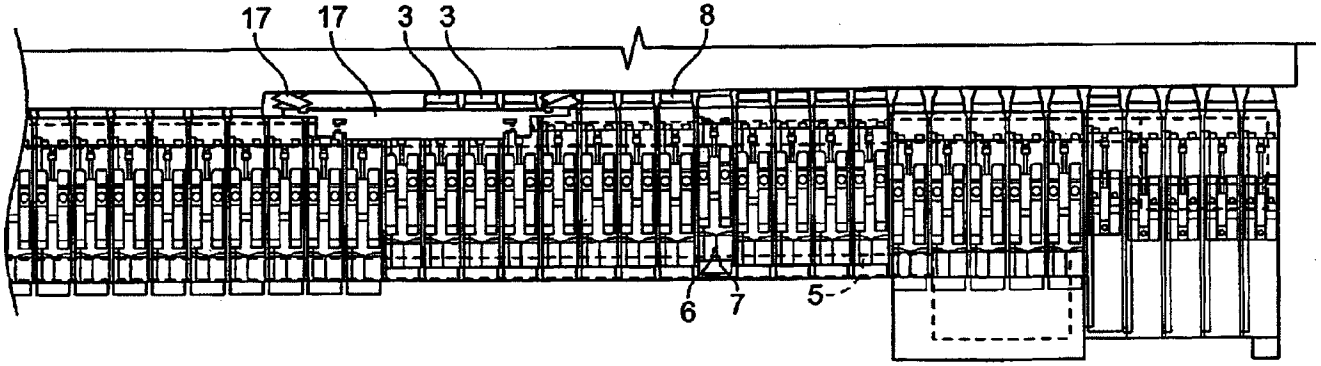
FIG. 2 shows the shearer on a first pass and canopies of the shields being operated in a first cycle.

In operation, the shearer moves to the left, as viewed, and cuts into the long wall 9 as it travels away from the tail gate end 12 on a first pass. As illustrated in FIG. 2, the flippers 8 in front of the shearer 15 are retracted as the shearer advances to the left and the shields 3 behind the leading drum 17 of the shearer 15 are stepped forward and the flippers 8 re-deployed accordingly.

Ideally, the first pass of the shearer 15 serves to cut a large portion of a web of coal from the long wall 9. After the shearer 15 has passed, individual canopies 6 and slide doors 7 are automatically operated by a controller (not shown) in a first cycle, to regulate a limited flow of coal which caves onto the rear conveyor carried by rear pan line 5. The caved coal provides a relatively constant but lesser volume of coal compared to that generated by the shearer 15. Both the caved coal and the cut coal are subsequently combined so that the extraction arm 2 provides a relatively constant high flow output.

Figure 3:
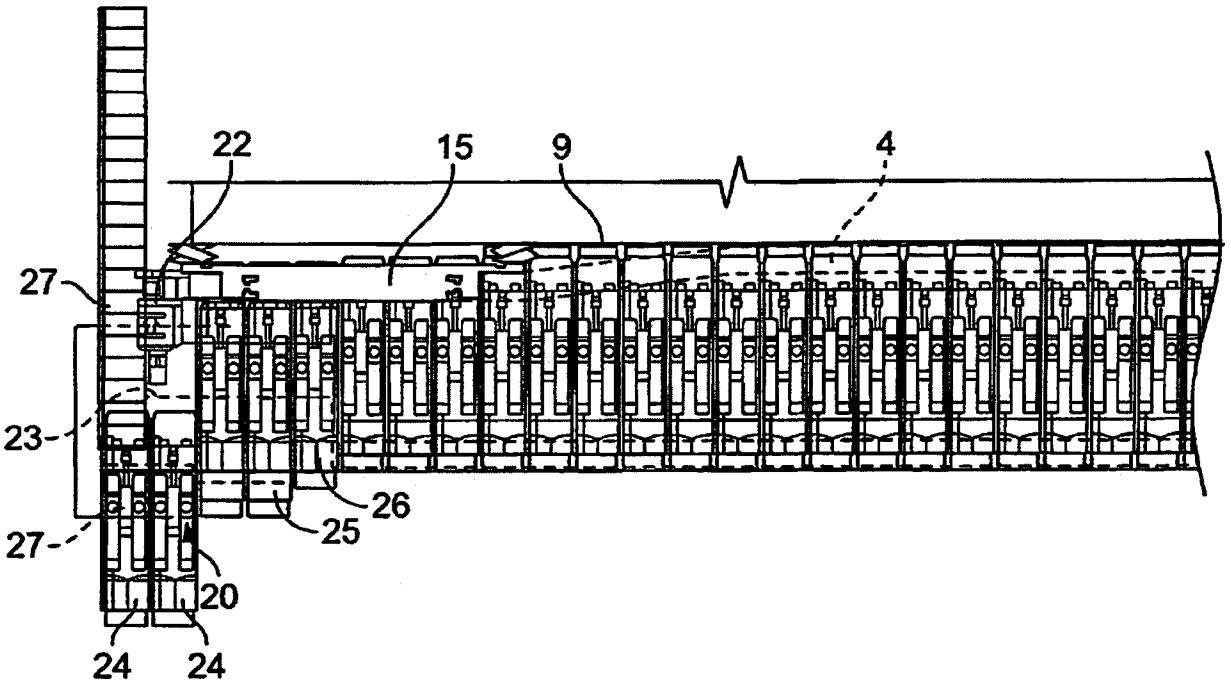
FIG. 3 shows the shearer at a main gate end of the system.

In FIG. 3, the shearer 15 is shown at an end of travel position adjacent a main gate (MG) 20. Also illustrated are other main gate components such as main gate front and rear drives 22, 23, for driving the conveyors, two buttress shields 24, two special shields 25 and a transition shield 26.

As can be seen, the front pan line 4 has been progressively snaked in behind the shearer 15 to lie immediately adjacent the long wall 9, in preparation for the shearer 15 to return back toward the tail gate 12, on a second pass of the long wall 9.

The caving cycle has also been completed and all of the coal generated from both the shearer on the first pass and the caved coal from the first cycle is delivered along the pan lines 4 and 5 to a beam stage loader 27.

Figure 4:
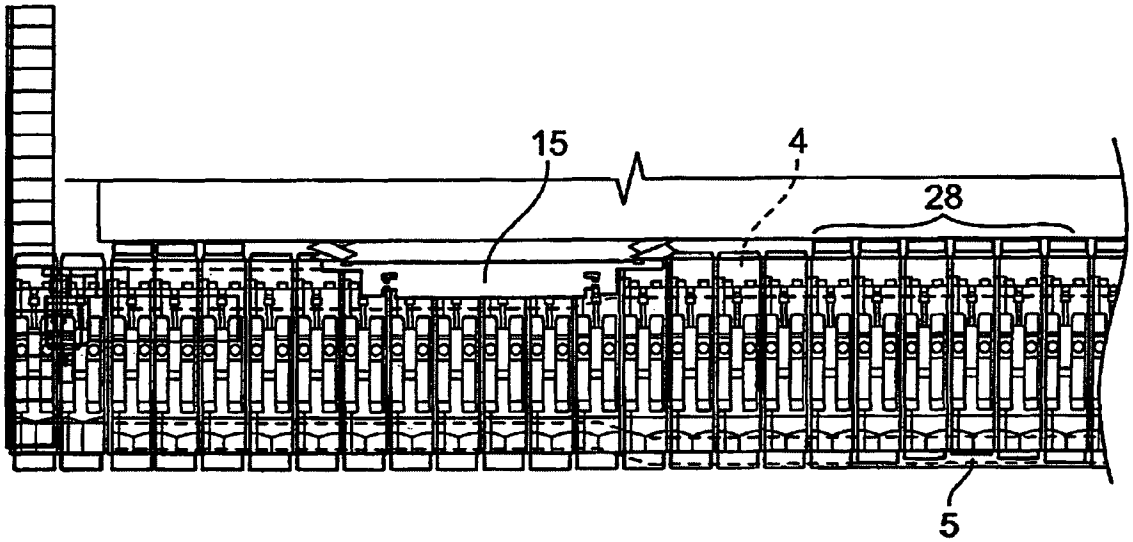
FIG. 4 shows the canopies being operated in a second cycle and the shearer on a second pass.

The canopies 6 are then operated in a second cycle in groups, to selectively cave in a direction back toward the tail gate 12. One such group is indicated by reference numeral 28 in FIG. 4.

Once the second cycle has been initiated, the shearer 15 commences its second pass cutting into the long wall to remove the remaining portion of the web.

Since the canopies are allowed to cave as a group, the volume flow of coal carried along the rear pan line 5 increases substantially, which helps supplement the reduced volume along the front pan line 4.

Figure 5:
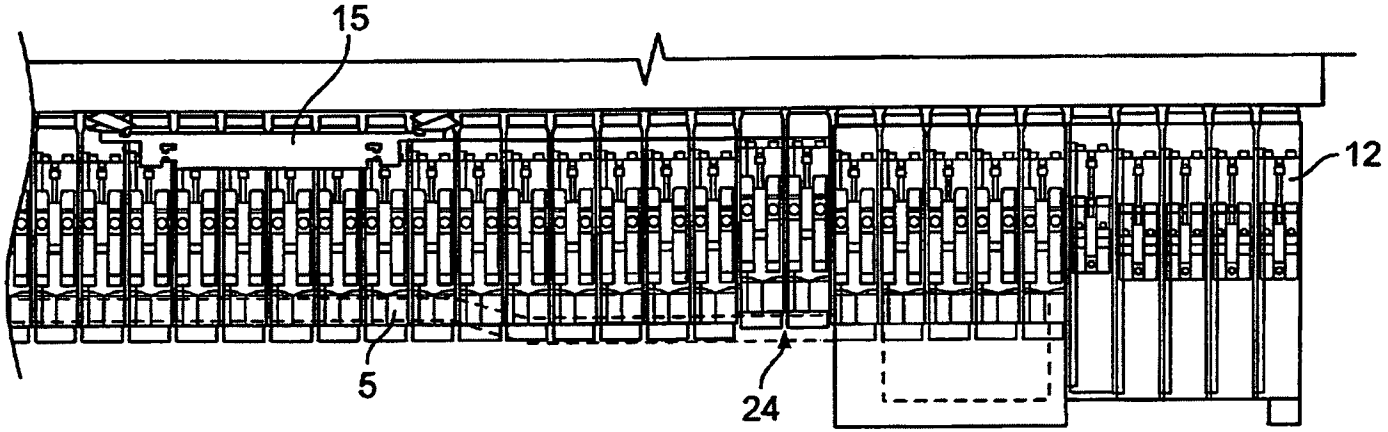
FIG. 5 shows the canopies at an end of the second cycle.
Figure 6:
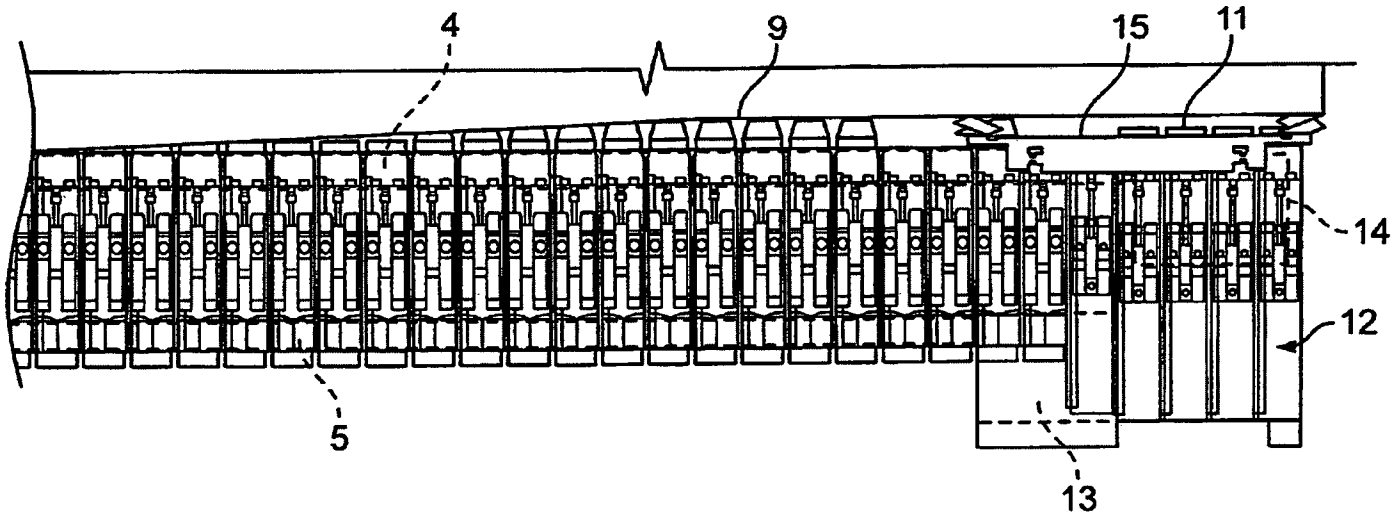
FIG. 6 show the shearer at an end of the second pass, back at the tail gate.

The rear pan line 5 is snaked in behind the leading group 28 as the caving moves back toward the tail gate end 12, as illustrated more clearly in FIG. 5 so that the pan line 5 is positioned against the shields, and the main gate drive 23 is also shunted across.

After the second cycle is complete, the shearer 15 continues to move to the right, as viewed, and cuts into the long wall 9 while the front pan line 4 is pushed against the long wall 9. The tail gate drives 13,14 are also moved forward so that the front pan line 4 and rear pan line 5 are in a straight configuration, when the shearer 15 finally stops at an end of travel position adjacent the tail gate 12. In that position, the end gate shields 11 are stepped forward, whereby the system 1 is again ready for another cutting and caving sequence.

As may be appreciated from the above, supplementing the cut coal of each pass with low flow and then high flow caving helps to regulate and unify the total output to the coal extraction arm regardless of whether the shearer is on the first pass or the second pass and this has considerable operational advantages. Also, separating the cutting process into two stages or passes means that load bearing requirements of the various machinery components is considerably less than if the entire web was cut at the one time. As such, the conveyors, drive motors and pan line construction can all be rated for lower operational requirements, which can lead to significant cost savings.

In addition, it should be noted the automated caving of the above described system 1 all occurs downstream of the shearer 15, in so far as the caving occurs between the shearer 15 and the tail gate 12. This is significant in that the entire extraction arm 2 may be subject to a general air flow in a direction from the main gate 20 to the tail gate 12, for dust control purposes, which means personnel working at the shearer 15 will be protected from dust generated by the caving process.

It should also be appreciated that by automating the caving cycle considerable efficiencies have been achieved compared to the prior manual caving technique. Manual caving can take about 3 minutes per shield whereas the automated system can cave at a rate of up to 35 seconds. This significantly improves operational output of the extraction arm.

By way of further explanation in relation to the caving process described above, reference is now made to FIG. 7, which illustrates one of the shields 3 and shows a main canopy 30 supported above a pontoon 31 on hydraulic legs 32. The canopy 30 is for supporting a roof 33 of the mine 34. A flipper 8 extends from the canopy 30 against a face 35 of the mine 34. The canopy 30 and flipper 8 provide protection for the panline 4 and front conveyor 36, which transport coal along the face 35, as it is cut from the face 35.

In the position shown, the conveyor 36 has been moved forward relative to the pontoon 31, ready for a new cutting cycle at the face 35.

The shield 3 also includes a rear canopy 6 which protects the rear panline 5 and rear conveyor 37. The rear canopy 6 is moveable via a hydraulic cylinder 38 between an elevated position, as shown, and a retracted position where coal is allowed to cave onto the conveyor 37. The rear canopy 6 has an associated slide door 7 which is extended to stop flow of coal caving onto the conveyor 37 but which can also be retracted to allow a lesser amount of caving onto the rear conveyor 37.

During the first cycle described above, the slide door 7 of each individual shield 3 is selectively opened to allow a limited amount of coal to cave onto the conveyor 37. During the second cycle, the rear canopy 6 can also be retracted to increase the volume of coal being caved onto the conveyor 37. To stop the flow of coal, the rear canopy 6 would then be elevated back to the position shown and the door 7 subsequently closed.

Figure 8:
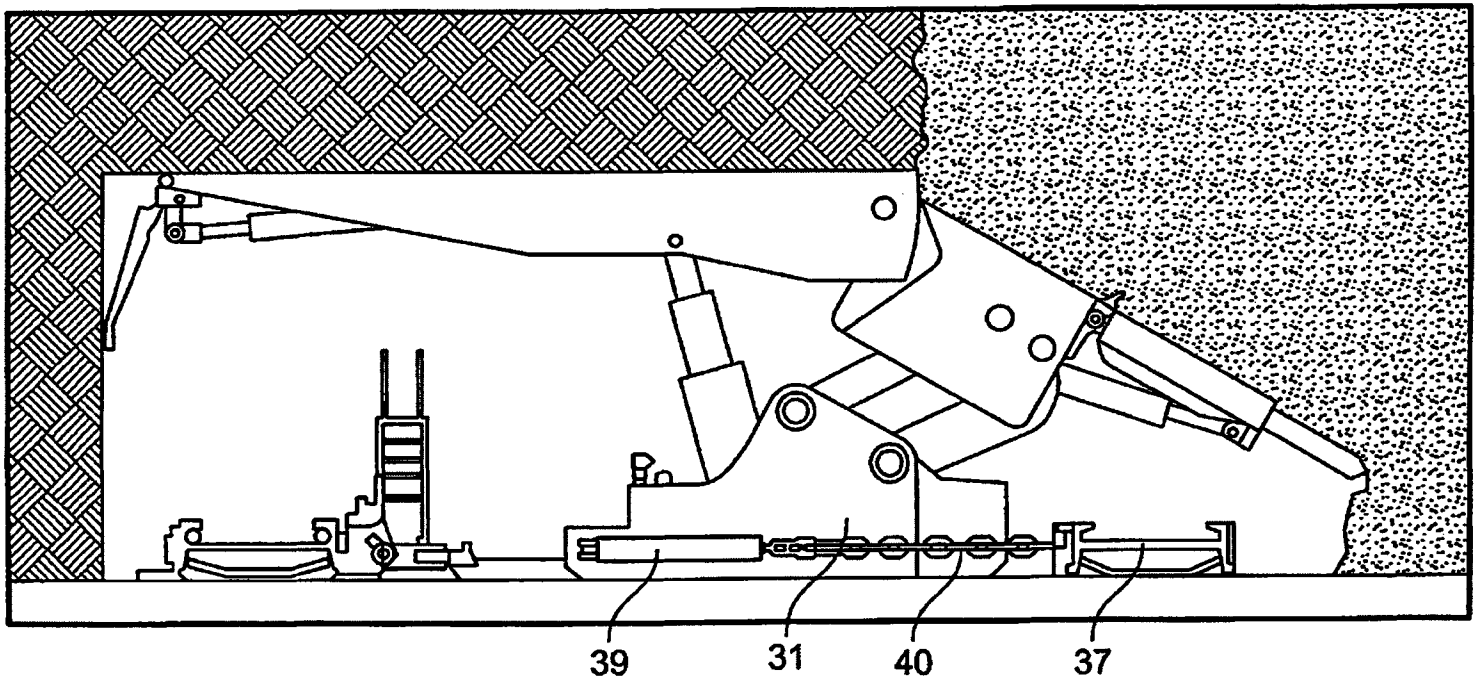
FIG. 8 is a view similar to that of FIG. 1, showing a rear conveyor in a retracted position.

After the caving process is finished, the rear panline 5 and conveyor 37 are moved in toward the pontoon 31 to allow the overall shield 3 and system 1 to walk forward in a direction from right to left, as viewed, during each cutting cycle. For that purpose, a piston 39 and chain 40 are used to retract the rear conveyor 37 to a position adjacent the pontoon 31, as shown in FIG. 8.

Referring now to FIGS. 9A to 9F, a coal caving technique, such as used during the second cycle, is described in more detail.

Figure 9A:
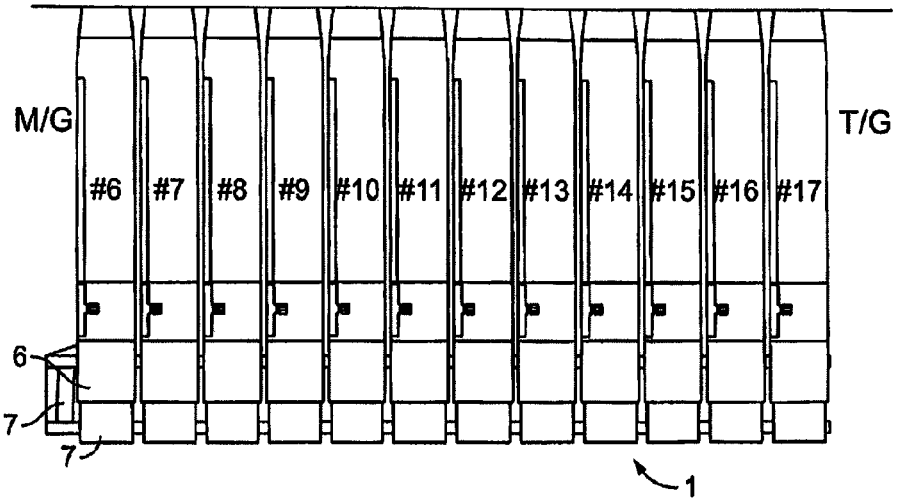
FIGS. 9A to 9F are diagrammatic plan views illustrating a caving sequence.
Figure 9B:
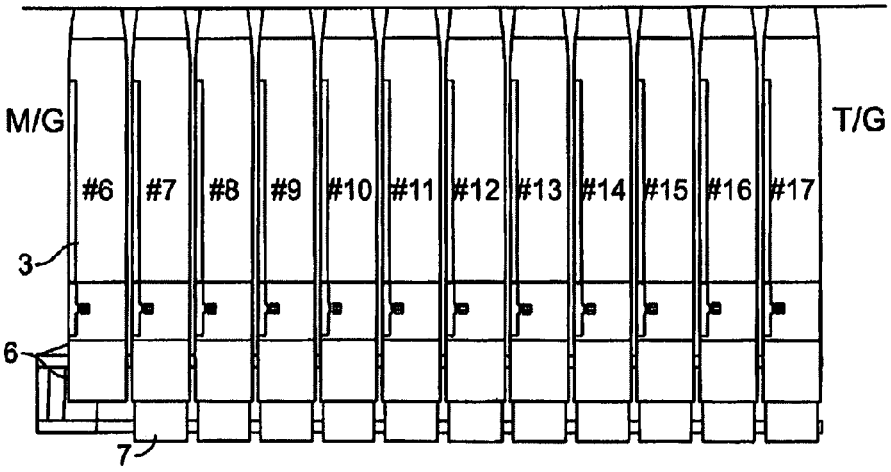

FIG. 9A is a diagrammatic plan view of a selected number of shields 3 of the system 1. Each shield has a rear canopy 6 and a slide door 7, arranged over the rear conveyor 37. One of the shields, indicated as shield #6, is located closer to the main gate (MG) while shield #17 is located closest to the tailgate (TG).

The caving sequence described is in a direction away from the main gate, in advance of the shearer 15, so the shield #6 will be the first shield to cave. It should be appreciated that the system 1 includes a controller and sensors (not shown) which continually monitor the positions of the shield doors and rear canopies. The controller, also effects movements of the door and canopy of the various shields between selected positions for predetermined periods of time during a coal caving operation. To that end, the door 7 associated with shield #6 is retracted from a position 100% extended to 0% extended, which may occur over a 3 second interval, to a position shown in FIG. 9B.

Figure 7:
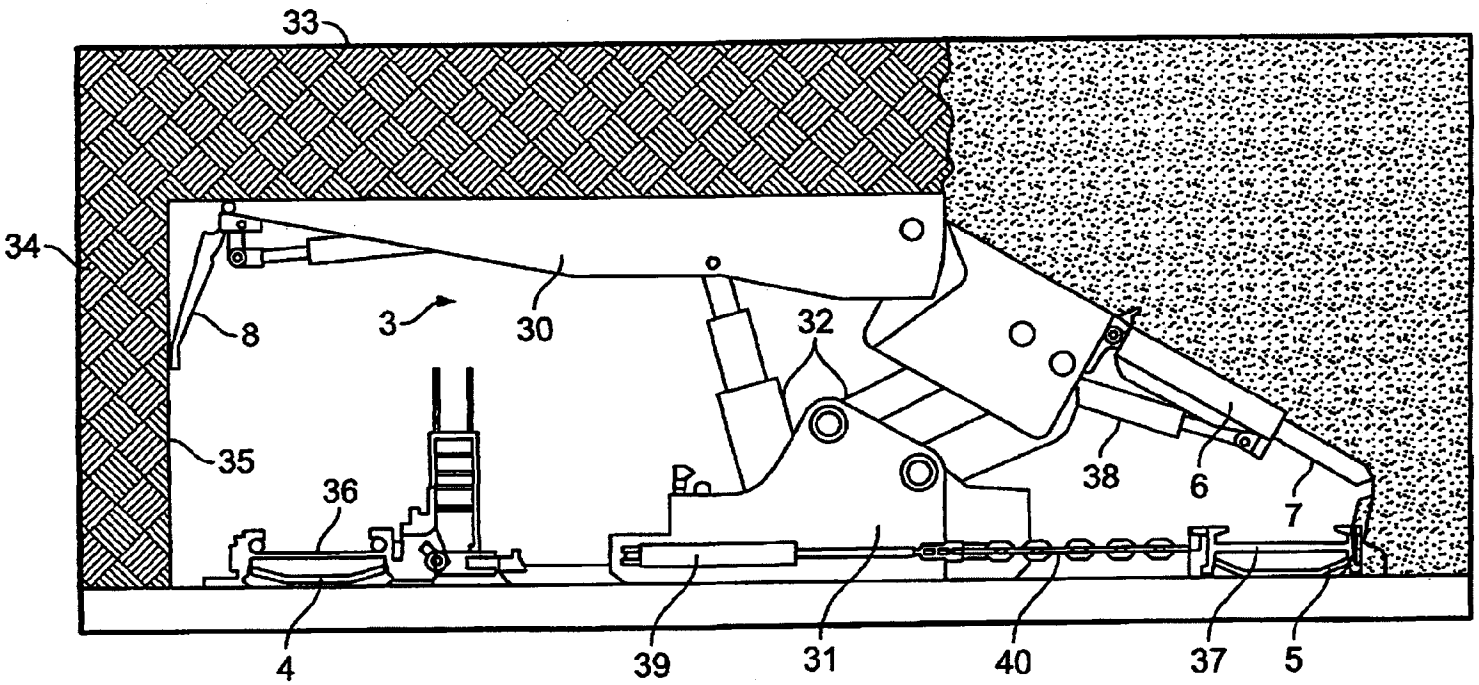
FIG. 7 is a diagrammatic side view of a shield used in the system of FIG. 1.
Figure 9C:
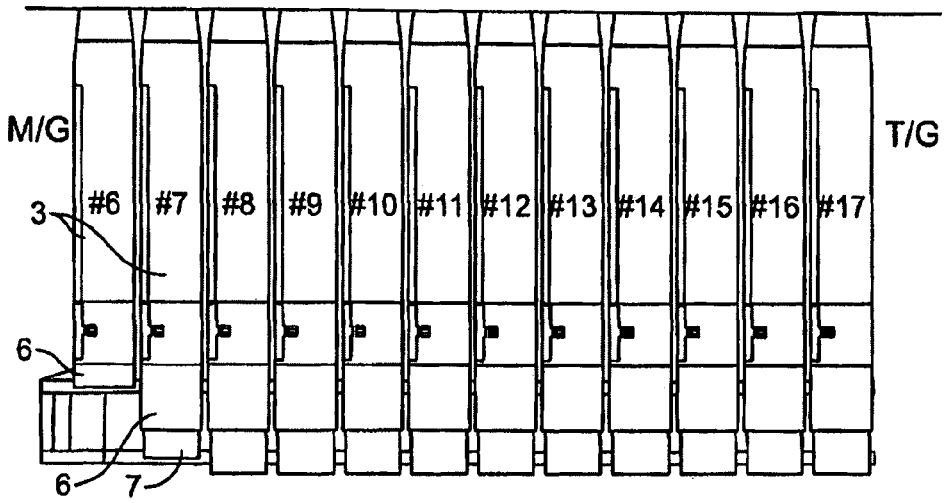

The rear canopy 6 is then moved from the position of about 85% extended, which corresponds to the position shown in FIG. 7, to an intermediate retracted position which triggers shield #7 to commence caving, such that the associated door 7 starts to move, as illustrated in FIG. 9*c*, from the 100% extended position toward the 0% extended position.

FIG. 9C also illustrates the rear canopy 6 of shield #6 in a fully retracted or opened position, where a large volume of coal from above the shield is free to cave onto the conveyor. The rear conveyor may take in the order of 4 seconds to move from the 85% extended position to the 0% extended position.

Figure 9D:
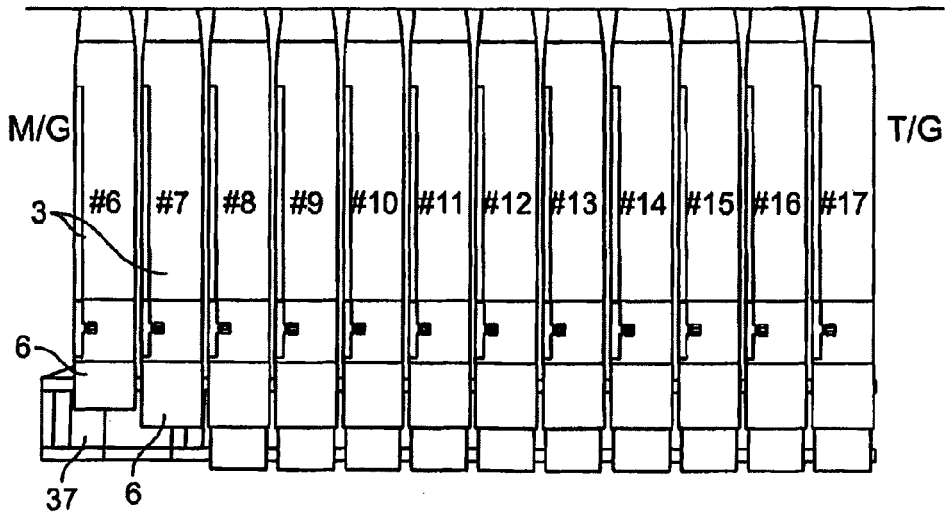

In FIG. 9D, the rear canopy 6 of shield #6 has commenced a return to the 85% extended position, which again may take in the order of 4 seconds, while the door 7 of shield #7 is fully retracted, increasing the amount of coal caving onto the rear conveyor 37.

Figure 9E:
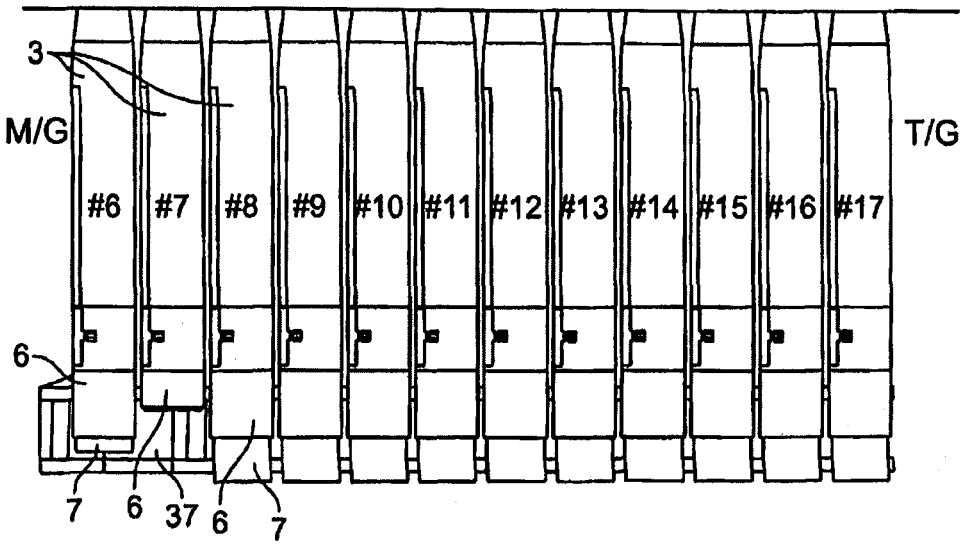

FIG. 9E illustrates the rear canopy 6 of shield #6 back in the 85% extended position, with the door 7 starting to move over a 3 second period back from the 0% retracted position to the 100% extended position. FIG. 9E also shows the rear canopy 6 of shield #7 moving through the intermediate position, which triggers the caving operation of adjacent shield #8.

Figure 9F:
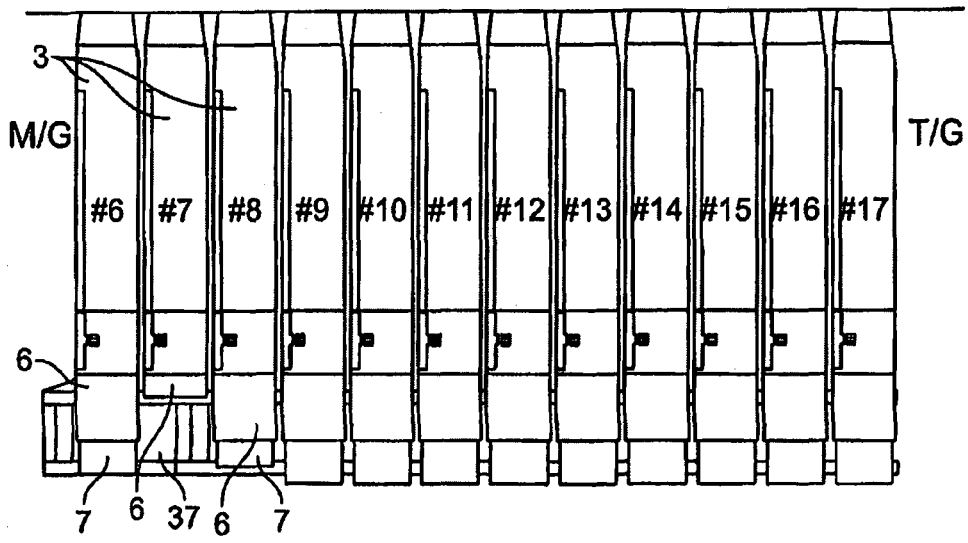
Figure 10:
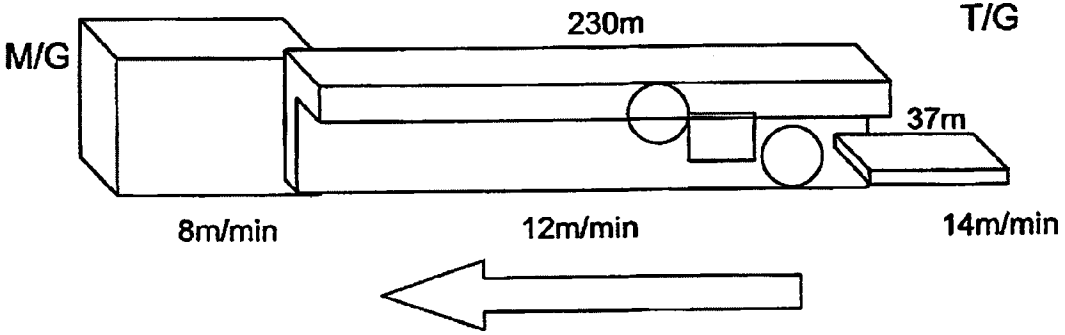
FIG. 10 is, a diagrammatic view of the shearer cutting from the tail gate to the main gate.
Figure 11:
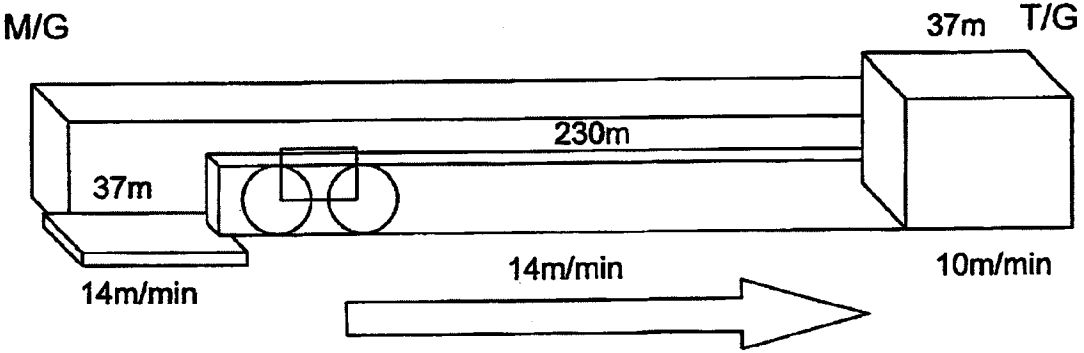
FIG. 11 is a diagrammatic view of the shearer cutting from the tail gate to the main gate.

FIG. 9F shows shield #6 completing a caving operation, with the rear canopy 6 returned to the original position and the door 7 almost back to the 100% extended position. Meanwhile, the canopy 6 of shield #7 has moved to the 0% extended position and the door 7 of shield #8 is shown retracting from the 100% extended position, toward the 0% extended position. The rear canopies 6 and doors 7 for each of the shields #7 and #8 are sequenced to then follow the same movements as for shield #6.

The caving sequence described above is propagated along the shields 3 toward the tail gate until all of the shields have completed a caving operation. The caving sequence has been described by reference to one shield finishing a caving operation while an adjacent shield is simultaneously undergoing caving and a third shield is commencing a caving operation. However, a greater number of shields can be sequenced together so to form a larger group of simultaneously caving shields. A caving sequence for a group of, for example, six shields is described in the Example below.

In either case, however, it is preferred the relevant shields 3 have the capacity to cave in order to meet the timing requirements above. In some cases, the rear canopy 6 may need to be raised and lowered a number of times to crush and loosen coal above the shield 3 to facilitate further caving or the slide door 7 may need to be moved in smaller increments if the caving operation is spread over a larger number of shields 3. Accordingly, each shield should, for example, have a caving cycle specification that allows:

- the slide door 7 to retract from 100% to 0%;
- the slide door 7 to stay on 0% for X seconds, where X is an adjustable parameter;
- the rear canopy 6 to retract from 85% to X %, where X % is an adjustable parameter;
- the rear canopy 6 to stay on X % for Y seconds, where Y is an adjustable parameter;
- the rear canopy 6 to extend from X % to 85%;
- the rear canopy 6 to stay on 85% for X seconds, with the slide door on 0%, X being an adjustable parameter;
- steps c to f to be repeated X times, where X is an adjustable parameter;
- the slide door 7 to extend to 30% and stay for X seconds, where X is an adjustable parameter;

the slide door 7 to extend to 60% and stay for X seconds, where X is an adjustable parameter;

the slide door 7 to extend to 100% caving to be completed when the door 7 and canopy 6 are returned to their original positions.

As will be clear from the above, multiple doors and/or canopies are sequenced to open as a group ahead of the shearer 15 as it moves from the main gate 20 to the tail gate 12. This corresponds to a lesser amount of coal being cut by the shearer 15 and transferred along the front conveyor so a larger amount of coal needs to be caved onto the rear conveyor 37 to normalise output to the beam stage loader 27. When the shearer 15 is taking a larger cut of coal as it moves from the tail gate 12 to the main gate 20, a much lesser amount of caved coal is required so only the doors 7 of the relevant shields 3 need to be opened individually, without moving the associated rear canopies 6, in a cycle which follows progress of the cutter.

Figure 12:
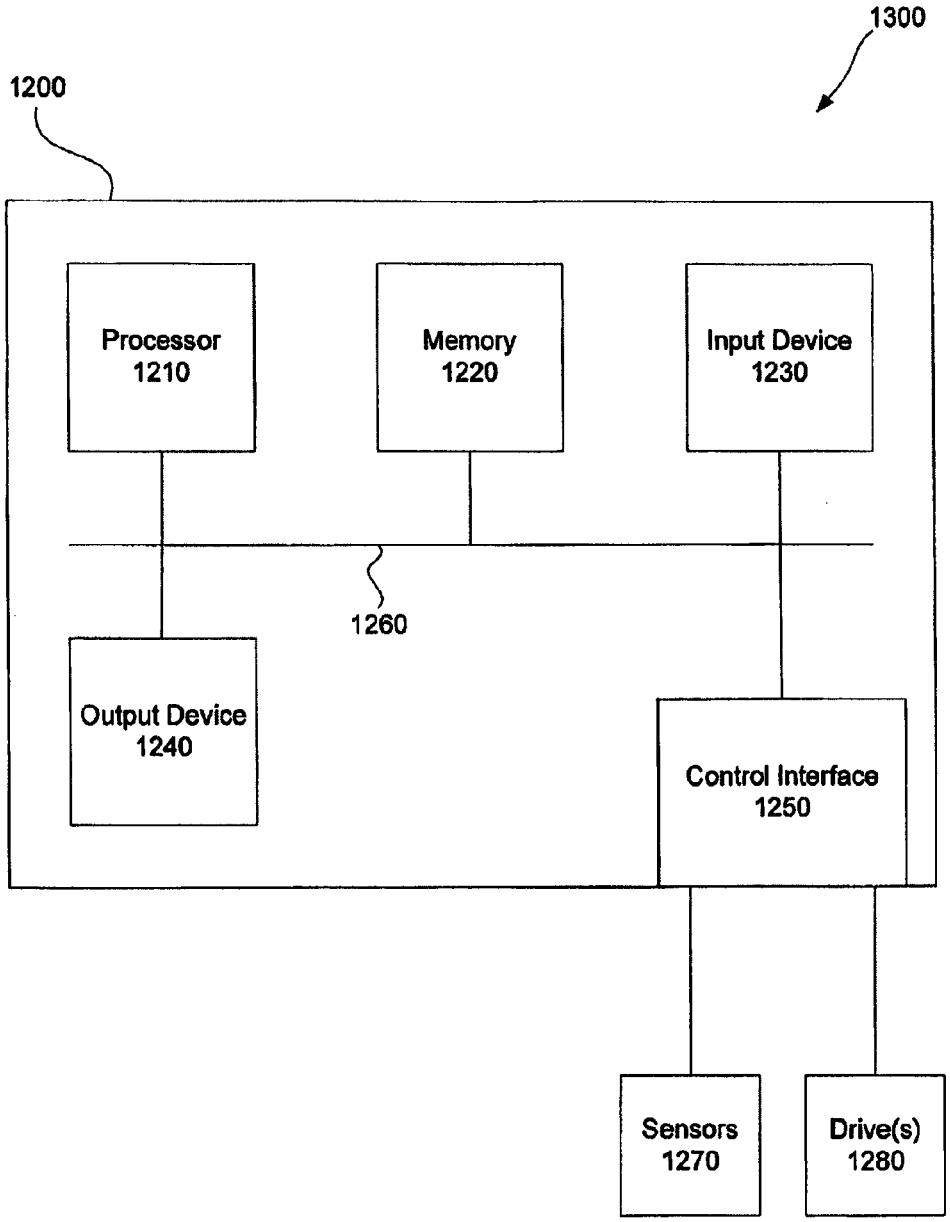
FIG. 12 is a functional block diagram of an example control system.

Referring to FIG. 12 there is shown a functional block diagram of an example control system 1300 for use in embodiments described. In particular, the control system 1300 includes a controller 1200 which is in communication with sensors 1270 and one or more drives 1280. The controller 1200 includes a processor 1210, a memory 1220, an input device 1230, an output device, 1240, and a control interface 1250, electrically coupled via a bus 1260. The controller 1200 is in communication with the sensors 1270 and drives 1280 via the control interface.

In a preferred form, the controller 1200 has stored in memory 1220 computer executable instructions representing a computer program which, when executed by the processor 1210, can autonomously control at least some of the drives 1280 via feedback signals received from the sensors 1270.

Figure 13:
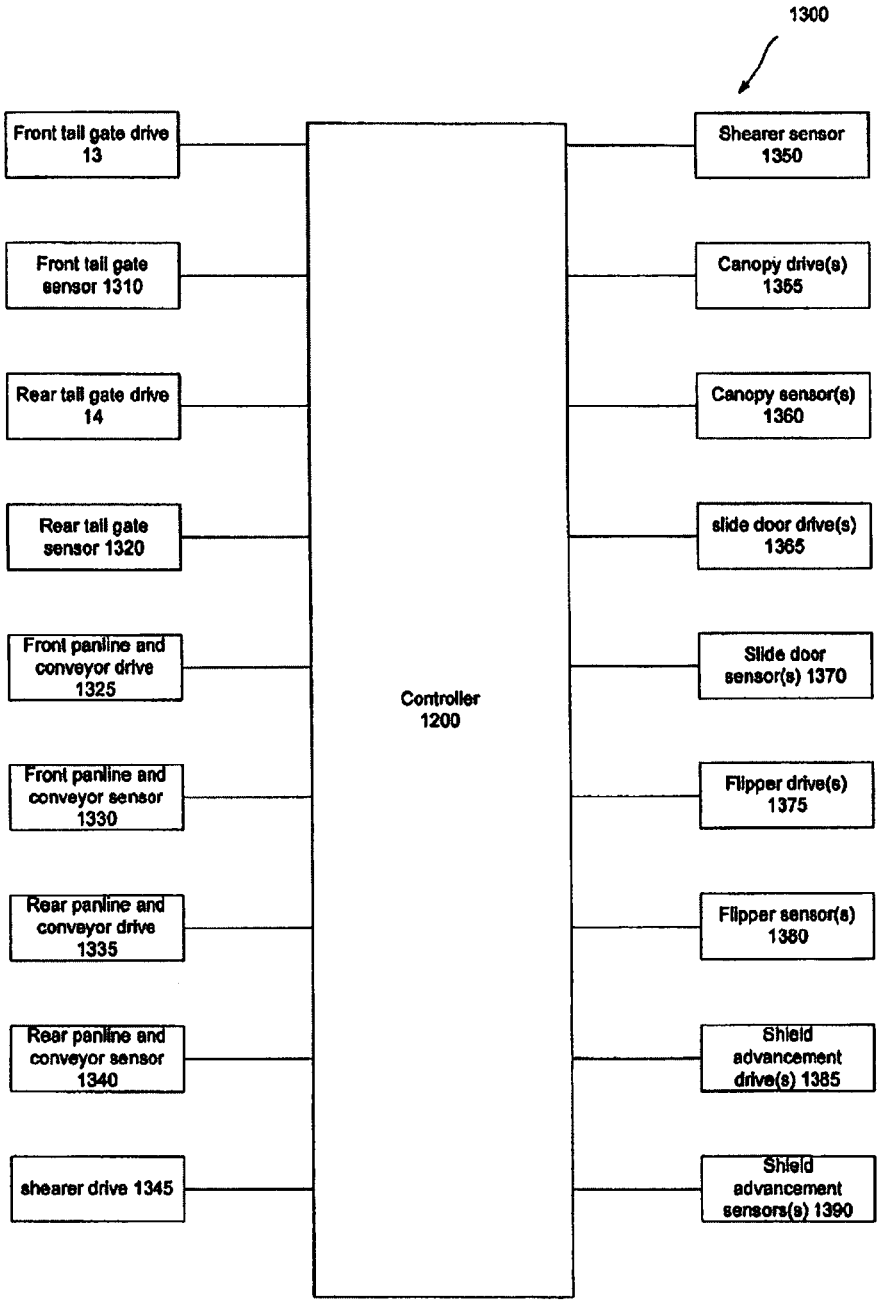
FIG. 13 is a functional block diagram of another example control system.

Referring to FIG. 13 there is shown a functional block diagram of another example of the control system 1300. In particular, the sensors 1270 of the control system 1300 which the controller 1200 is in communication with include a front tail gate sensor 1310, a rear tail gate sensor 1320, front panline and conveyor sensor 1330, a rear panline and conveyor sensor 1340, a shearer sensor 1350, one or more canopy sensors 1360, one or more slide door sensors 1370, one or more flipper sensors 1380, and one or more shield advancement sensors 1390. The controller 1200 can be configured to receive feedback signals from each of these sensors 1270 in order to automatically perform the above described method.

The controller 1200 is also in electrical communication with the drives 1280 of components of the system including front tail gate drive 1305, rear tail gate drive 1315, front panline and conveyor drive 1325, rear panline and conveyor drive 1335, shearer driver 1345, one or more canopy drives 1355, one or more slide door drives 1365, one or more slide door sensors 1370, one or more flipper drives 1375, one or more flipper drives 1380, and one or more shield advancement drives 1390.

In operation, the controller 1200 maintains a direction variable in memory to indicate the cycle pass of the shearer. Initially, the direction variable is set to the first cycle, wherein the shearer 15 moves to the left, as previously discussed in relation to FIG. 2. As the shearer 15 moves, the controller 1200 receives a feedback signal from the shearer sensor 1350. In particular embodiments, the controller 1200 controls the movement of the shearer 15 via a control signal which is transferred to the shearer drive 1345. However, in other embodiments, the shearer drive 1345 may be controlled by another control system.

The feedback signal received from the shearer sensor 1350 is indicative of the position of the shearer 15. The processor 1210 of the controller 1200 compares the shearer position against a number of thresholds stored in memory 1220 in order to begin actuation of appropriate flipper drives 1375, wherein appropriate flippers 8 are retracted accordingly. The controller 1200 receives feedback signals from the flipper sensors 1380 in order to control the respective flipper 8 movement.

Once the processor 1210 determines that the current position of the shearer 15 has passed the location of particular shields 3, the appropriate shield advancement drives 1385 are actuated by the controller 1200 to cause the respective shields to move forward. The controller receives a shield advancement signal from the shield advance sensors 1390 indicative of the advance of each respective shield in order to control the shield advancement. In addition, the flipper drives 1375 of the flippers 8 of the advanced shields 3 are actuated by the controller 1200 to cause the respective flippers 8 to be redeployed. The controller 1200 receives a flipper deployment signal from each flipper sensor 1380 of a flipper 8 in the process of being redeployed in order to control the redeployment. Additionally, after the shearer 15 has passed, individual canopy drives 1355 of canopies 6 and slide door drives 1365 of slide doors 7 are actuated by the controller 1200 to regulate the limited flow of coal which caves onto the rear conveyor carried by the rear pan line 5.

Once the shearer 15 has reached the main gate, the second cycle is initiated, wherein the processor 1210 updates the direction variable in memory 1220 and the processor 1210 of the controller 1200 determines a group of canopies which are to be actuated in order to increase the caving. Upon determining the group of canopies, the controller 1200 transfers a plurality of signals to a plurality of canopy drives 1360 to be actuated as a group accordingly. The controller receives canopy signals from the canopy sensors 1360 of the actuated canopies to control the actuation thereof. Preferably, the controller 1200 also transfers a plurality of signals to the slide door drives 1365 which correspond to the determined group of canopies in order to control the retraction and extension thereof to control the flow rate. The controller 1200 receives slide door signals from the slide door sensors 1370 in order to control the actuation of the slide doors 7.

Once the second cycle has been initiated, the shearer 15 commences its second pass which can be controlled by the controller 1200 transferring a control signal to the shearer drive 1345, although as stated above, this is not essential as another control system may control the movement of the shearer.

As the shearer 15 continues to move and cut into the long wall 9, the appropriate front pan line and conveyor drives 1325 are actuated by the controller 1200 accordingly such that the front pan line 4 is pushed against the long wall 9. The controller controls the actuation of the appropriate front pan line and conveyor drives 1325 via receiving signals from the front pan line and conveyor sensor 1330. The controller 1200 actuates the tail gate drives 13, 14 so that the front pan line 4 and rear pan line 5 are in a straight configuration, wherein signals from front and rear tail gate sensors 1310, 1320 are used as feedback to control the actuation accordingly. As the shearer 15 passes, the controller 1200 actuates the rear pan line and conveyor drive 1335, wherein signals received from the rear pan line and conveyor sensor are used to control actuation thereof. Once the shearer 15 reaches the tail gate, the controller 1200 actuates the end gate shield drives 1385 which cause the respective end gate shields to step forward.

It will be appreciated that the input device 1230 of the controller 1200 can enable a user to provide input commands to control the operation of the system. The input device 1230 may be provided in the form of a keyboard or various buttons of a control panel. The output device 1240 of the controller 1200 can be provided in the form of a display screen.

EXAMPLE

A specific example of the LTCC system cutting and caving cycle is provided below.

1. General Information

In one possible application, the LTCC system described below is intended for use with the following basic operating parameters, which are provided by way of non-limiting example only.

1.1 Coal Block to be Mined

Width: 304.9 m (centre line to centre line)

Cross grade: 10:1 (Fall from TG to MG)

Gate road dimensions: 3.6 m high, 5.2 m wide

Seam thickness: 6.5 m

Block length: LW8-2963 m, LW9-2971 m, LW10-2482 m.

1.2 Equipment 1.2.1 Shields

Collapsed height: 2.1 m (Gate shields—2.4 m)

Full extension: 4.5 m Working range: 3.5 m to 3.8 m

Shields width: 2.05 m Shield centres: 2.050 m

Total number of shields: 149

Web: 1 m 1.2.2 Conveyors

Rear Armoured Face Conveyor (RAFC) capacity: 3000 T/hr

Front Armoured Face Conveyor (FAFC) capacity: 3000 T/hr

Beam Stage Loader (BSL) capacity: 4500 T/hr 1.2.3 Shearer

Capacity: 3000 T/hr

Operating range: 3.5 m to 3.8 m

Maximum extraction height: 4.2 m

Drum diameter: 2.2 m 20 Web: 1 m

Shearer length: 14 m (Drum centre to drum centre)

2. Overview of Cut Cycle

The cut cycle to be utilised is a variation on the Uni-Di model employing a partial web method. When travelling from the Main Gate (MG) to the Tail Gate (TG) the shearer cuts 30% of the one meter web and when travelling from the TG to the MG the shearer cuts the remaining 70% of the web. That is the shearer travels the face twice for one complete shear. FIG. 7 shows the intended extraction when the shearer is cutting from TG to MG and FIG. 8 details the intended extraction when it is cutting from MG to TG.

3.1 Shield Advance Methodology

The Shield Operation mode is as listed, with each of the shields being numbered consecutively, with the number 1 being allocated to the shield closest to the main gate.

Conventional Mode

2 Buttress Shields Maingate No 1 & No 2

2 Special gate end shields Maingate No 3 & No 4

1 Transition Shield Maingate end No 5

1 Transition Shield Tailgate end No 145

4 Special gate end shields Tailgate No 146, 147, 148, 149

1 Web Back Mode

139 Run Of Face shields

Shields are advanced 2 shields behind the Leading Cutting drum on the Tail to Main Cut commencing at 144

3.2 Front Armoured Face Conveyor (FAFC) methodology

The FAFC pans move twice, during the cut cycle. When the shearer is cutting from the TG to the MG, after the shields are advanced, the FAFC pan line has a forward snake applied at the TG. Then a 30% push is continued a safe distance behind the shearer, stopping 40 meters from the MG.

When the shearer is cutting MG to TG the FAFC pan line is pushed over the remaining 70% of the one meter web, again being a safe distance behind the shearer.

3.3 Caving Methodology

The caving process occurs twice during the cut cycle. When the shearer is cutting from the TG to the MG a low flow caving process takes place with only single door caving occurring. When the shearer is cutting from the MG to the TG a high, flow caving process takes place with multiple, adjacent door caving occurring.

3.4 Rear Armoured Face Conveyor (RAFC) Methodology

The RAFC pans move only once during the cut cycle. When the shearer is cutting from the MG to the TG the RAFC is snaked in a full web following the high flow caving to the TG after the Beam Stage Loader (BSL) push has occurred.

3. Detailed Cut Cycle

The following sections will step through one example of a detailed cut cycle. The explanation of the cut cycle will start with the shearer in the TG at the electrical stop. As shield functions will be initiated by the shearer position each section will be identified by the shearer activity at that time.

4.1 Shearer at TG Ready to Start Cutting to the MG

The face equipment is in the following position at this stage.

Flipper bars on Shields 149>139 are retracted over the shearer.

The shields advance over the shearer 2 shields behind the leading drum commencing at 144. (145>>149 are operating in Conventional mode so they are already advanced)

All other shields from 144 to 6 are one web back.

Gate shields 3, 4, and 5 are in conventional mode

All shield flippers are deployed from shield 139 to 3. The flippers on. shields 140 20 to 149 are retracted.

Shields 1 and 2 are advanced

All caving doors are closed.

The FAFC is straight

The RAFC is straight and pulled in.

4.2 Shearer Starts Cutting from TG to MG into a 70% Web

1. Shield flippers are retracted to the vertical position four shields (Safety Zone set by controller PMC-R parameters) in front of the lead drum as the shearer travels towards the MG.
2. Two shields from the lead drum (Safety Zone set by PMC-R parameters) the flippers are fully retracted to allow the lead drum to pass.
3. Shields are then lowered and advanced a full web, two shields (Safety Zone set by PMC-R parameters) behind the lead drum. The first shield to be advanced is 144. The next is 143 then the remainder of the shields sequentially towards the MG. i.e. 140, 139, etc.
4. After each shield is advanced and set the flipper is extended two shields (Safety Zone set by PMC-R parameters) behind the trailing drum. They are set a target of 100% so that they will support the face regardless of its integrity.
5. Once the shearer has cut to a machine position of shield 124 (Set by PMC-R parameter "S TG push") and the shields have advanced to this point, the TG front drive is pushed over a full web. The full web push will continue down to 141 shield. A tapered push will then occur from 141 shield (100%) to 128 shield (0%). (BP snake length set by PMC-R parameters and Safety Zone set by PMC-R parameters)

6. After the TG front drive and pan line is fully pushed down to 141 the TG gate shields are advanced in the sequence 145, 146, 147,148 and then 149. The flippers of these shields need to be retracted to the vertical position prior to each shield advancing and then set back to the face.
7. While the TG push and TG gate shield advance is occurring the shearer is continuing to cut to the MG.
8. Single shield caving follows the advancing shields to the MG. A minimum gap of seven shields (Safety Zone set by PMC-R parameters) must be maintained between the last advanced shield and the caving. There is no limit as to how far the shearer is allowed to be ahead of the caving when cutting to the MG. The first shield to cave is 144.
9. Also following the advancing shields to the MG is a FAFC pan line push of 30% of a web. This push will be tapered in behind the shearer so that the push stops two pans (BP snake length set by PMC-R parameters and Safety Zone set by PMC-R parameters) behind the trailing drum. The pan push should only be triggered every time the shearer has travelled five shields. This enables the push to stay on for longer and hence the clevis pin climbs into the top of the pan push slot to give the pans more toe force. (S BP headway set by PMC-R parameters)
10. The RAFC is not pulled in while the shearer is cutting TG to MG.

4.3 Shearer Cuts into the MG Electrical Stop

11. The last shield to advance as the shearer cuts its way into the MG electrical stop is shield 6. (Safety Zone set by PMC-R parameters).
12. The last flipper to extend out following the trailing drum is on shield 13. (Safety Zone set by PMC-R parameters)
13. The last pan to be pushed over 30% is pan 23 (Safety Zone set by "S push MAIN" PMC-R parameter). The push will then be tapered from 23 shield (30%) to 11 shield (0%) (BP snake length set by PMC-R parameters and Safety Zone set by PMC-R parameters)
14. Once shield 6 is advanced the seven shield gap (Safety Zone set by PMC-R parameters) no longer needs to be maintained between the last advanced shield and the caving process. The caving can continue all the way to the MG with number 5 shield being the last shield to be caved.
15. As soon as the caving is complete on shield 5 the high flow caving cycle starts off towards the TG.
16. The RAFC is not pulled in while the shearer is cutting TG to MG.

4.4 Shearer Carries Out MG Clean up Shuffle and then Starts Cutting from MG to TG into a 30% Web 17. The high flow caving cycle is now working its way towards the TG. The caving process must stay 7 shields (Dust control Zone set by PMC-R parameters) ahead of the TG or lead drum of the shearer when cutting to the TG. If required the shearer must be stopped or slowed to maintain this gap.
18. When the shearer carries out the three shield clean up shuffle at the MG the flippers on shields 13, 14 and 15 retract to the vertical position four shields (Safety Zone set by PMC-R parameters) in front of the lead drum, and then fully retract once they are two shields (Safety Zone set by PMC-R parameters) from the lead drum. While the shearer travels back to the MG electrical stop the flippers extend back out against the face maintaining the 2 shield (Safety Zone set by PMC-R parameters) safety gap between the flippers and the TG drum.
19. Once the clean up shuffle is complete the shearer starts cutting to the TG. As with cutting to the MG the flippers retract to the vertical position four shields in front of the lead drum (Safety Zone set by PMC-R parameters), and then fully retract once they are two shields from the lead drum (Safety Zone set by PMC-R parameters). They are then extended two shields (Safety Zone set by PMC-R parameters) from the trailing drum. The difference with the MG to TG cut is that the shields are not advanced.
20. When the shearer reaches shield 28 (Set by PMC-R parameter "S MG push") the MG front drive and pan line is fully pushed over to shield 11. A tapered push will occur from 11 shield (100%) to 23 shield or 2 shields from the trailing drum (30%) (BP snake length set by PMC-R parameters and Safety Zone set by PMC-R parameters).
21. The MG special shields are now advanced in the sequence 4, 3 and then 5. The flippers of these shields need to be retracted to the vertical position prior to each shield advancing and then set back to the face.
22. By the time the MG Gate shields have been advanced the high flow caving cycle should be well on its way to the TG.
23. So the MG rear cross frame and BSL can be advanced a full web. The rear pan line pulls in straight for a bank of 9 pans from the MG with the MG cross frame and BSL for the full web advance. This is required so that the RAFC, cross frame and BSL can be kept square for the advance. The side shift cylinder will be activated during the BSL push if it is turned on in the PMC-R parameter menu.
24. The RAFC will now taper advanced towards the TG (RCP snake length set by PMC-R parameters and Safety Zone set by PMC-R parameters) until it catches up to the high flow caving cycle. The TG end of the taper must remain 2 pans from the MG side of the caving cycle.
25. The MG buttress shields 2 and then 1 will also advance while the rear AFC is advancing towards the caving cycle.
26. While all of the MG shield and pan movements are occurring the shearer and the high flow rear caving continue to progress towards the TG. Following the shearer to the TG the pan line is pushed to 100%. This push will be tapered in behind the shearer to 30%, two pans behind the trailing drum (BP snake, length set by PMC-R parameters and Safety Zone set by PMC-R parameters). The pan push should only be triggered every time the shearer has travelled five shields. (S BP headway set by PMC-R parameters). This enables the push to stay on for longer and hence the clevis pin climbs into the top of the pan push slot to give the pans more toe force.

4.5 Shearer Cuts into the TG Electrical Stop and then Completes the Clean up Shuffle 27. When the high flow caving cycle reaches shield 145 that is the end of the caving cycle to the TG.
28. The RAFC is now fully pulled in and the TG rear drive is also advanced a full web.
29. The front pan line push to 100% follows the shearer all the way to the TG until the whole pan line is straight again.
30. When the shearer carries out the three shield clean up shuffle at the TG the flippers on shields 139, 138 and 137 retract to the vertical position four shields (Safety Zone set by PMC-R parameters) in front of the lead drum, and then fully retract once they are two shields (Safety. Zone set by PMC-R parameters) from the lead drum. While the shearer travels back to the TG electrical stop the flippers extend back out against the face maintaining the 2 shield (Safety Zone set by PMC-R parameters) safety gap between the flippers and the MG drum.

5. Controller—PMC-R Special Requirements 5.1 Front Flipper Function

Flipper operation needs to be high speed.

As the shearer approaches the flippers will be retracted to the vertical position a set distance from the lead drum. This distance will be adjustable through PMC-R parameters.

Once the shearer reaches the safety zone set by the PMC-R parameters the flippers will fully retract.

Flipper extension target will be 100% so that the flipper extends until it imposes its full force into the face regardless of the face condition.

Extension and retraction targets should be adjustable through password protected PMC-R parameters.

Flippers need internal reed rods to achieved targeted retraction and extension and also anti collision.

5.2 Caving Function

Caving operation needs to be high speed.

Once the last face shield (6) has been advanced on the TG to MG cut and the shearer is at the MG electrical stop the safety zone for the distance between the last advanced shield and the auto caving process needs to be ignored so that the caving can progress to the MG and finish at the last advanced shield.

There is no limit as to how far the shearer is allowed to be ahead of the caving when cutting to the MG.

Adjacent caving is required for high flow caving to occur when cutting from MG to TG. The size of this group needs to be selectable up to 10 shields.

There must be a dust control zone that keeps the high flow caving process a set number of shields in front of the shearer when the shearer is cutting from MG to TG. This must be set by PMC-R parameters and be adjustable from 1 to 10 shields.

The PMC-R parameters need to allow for the selection of single door caving or high flow caving in either direction.

5.2.1 High Flow Caving Function

The High flow caving system requires a number of adjacent caving canopies to be operating at the same time. This group of shields caving together create one large caving window that progressively moves its way across the face. The size of the caving group is adjustable through the PMC-R parameters with a range from 1 to 10 shields.

For the purpose of explaining the system a group size of 6 shields will be nominated and the caving cycle will be starting at the first shield to be caved at the MG, shield No 6. The following chart explains the process from the start of the first shield caving to the completion of the last shield in the group.

High flow caving function—6 shield group

| Step | Shield 6 | Shield 7 | Shield 8 | Shield 9 | Shield 10 | Shield 11 | Shield 12 | Shield 13 | Shield 14 |
|---|---|---|---|---|---|---|---|---|---|
| 1 | slide retracts to 0% & caving canopy lowers to 0% | | | | | | | | |
| 2 | Caving canopy lifts to 60% | Slide retracts to 0% & caving canopy lowers to 0% | | | | | | | |
| 3 | Slide extends to 20% | Caving canopy lifts to 60% | Slide retracts to 0% & caving canopy lowers to 0% | | | | Waiting to cave | | |
| 4 | Slide extends to 40% | Slide extends to 20% | Caving canopy lifts to 60% | Slide retracts to 0% & caving canopy lowers to 0% | | | | | |
| 5 | Slide extends to 60% | Slide extends to 40% | Slide extends to 20% | Caving canopy lifts to 60% | Slide retracts to 0% & caving canopy lowers to 0% | | | | |
| 6 | Slide extends to 80% | Slide extends to 60% | Slide extends to 40% | Slide extends to 20% | Caving canopy lifts to 60% | Slide retracts to 0% & caving canopy lowers to 0% | | | |
| 7 | Slide extends to 100% & caving canopy lifts to park position. | Slide extends to 80% | Slide extends to 60% | Slide extends to 40% | Slide extends to 20% | Caving canopy lifts to 60% | Slide retracts to 0% & caving canopy lowers to 0% | | |
| 8 | | Slide extends to 100% & caving canopy lifts to park position. | Slide extends to 80% | Slide extends to 60% | Slide extends to 40% | Slide extends to 20% | Caving canopy lifts to 60% | Slide retracts to 0% & caving canopy lowers to 0% | |

-continued

High flow caving function—6 shield group

| | | | | | | | | | |
|---|---|---|---|---|---|---|---|---|---|
| 9 | | | Slide extends to 100% & caving canopy lifts to park position. | Slide extends to 80% | Slide extends to 60% | Slide extends to 40% | Slide extends to 20% | Caving canopy lifts to 60% | Slide retracts to 0% & caving canopy lowers to 0% |
| 10 | | | | Slide extends to 100% & caving canopy lifts to park position. | Slide extends to 80% | Slide extends to 60% | Slide extends to 40% | Slide extends to 20% | Caving canopy lifts to 60% |
| 11 | | Caving complete | | | Slide extends to 100% & caving canopy lifts to park position. | Slide extends to 80% | Slide extends to 60% | Slide extends to 40% | Slide extends to 20% |
| 12 | | | | | | Slide extends to 100% & caving canopy lifts to park position. | Slide extends to 80% | Slide extends to 60% | Slide extends to 40% |

Chart 1. Graphical representation of high flow caving utilising a shield group of 6

Note

1 The 6 shield group is completed its caving after step 11.

2 The next group of 6 shields starts its high flow caving process at step 7 before the first group is finished.

3 If a group of 5 shields was selected the percentages for the slide doors would be 25%, 50% then 75%

4 If a group of 4 shields was selected the percentage for the slide doors would be 33% and then 66%

5 If a group of 3 shields was selected the percentage for the slide doors would be 50%.

6 The first two and last caving canopy targets for each shield would need to be adjustable through the PMC-R parameters.

7 The timing between each step would need to be adjustable through PMC-R parameters.

8 The method of caving; high flow or conventional single door, would need to be selectable for both directions of shearer travel.

5.3 FAFC Pan Push Function

The front AFC pan push should only be triggered every five shields of shearer travel as per Austar software. This enables the push to stay on for longer and hence the clevis pin climbs into the top of the pan push slot to give the pans more toe force.

5.4 Shield Advance Function

The last shield to advance when cutting into the MG electrical stop on the main cut run is 6. At this stage all shields are fully advanced in the MG area. The only shields to advance when cutting into the TG electrical stop on the main cut run are 146, 147 and 148. No other shields are advanced when cutting to the TG electrical stop on the main cut.

Need to have PMC-R side seal control parameters for left and right hand side seals as there are operational side seals on both sides of the canopy. TG side will be locked in most of the time.

5.5 BSL Push Function

There has been a request for a side shift cylinder to be fitted to the BSL to assist in guiding the BSL off the pillar rib if required. The activation of this cylinder during 20 the BSL push should be able to be turned off or on through PMC-R parameters.

An extra cylinder has will be fitted between the Pontoon of No 2 & the M/G drive to assist with push of BSL & steering of the BSL.

5.6 BSL Current Control Function

When the BSL current control reaches a level that requires it to stop the caving process it needs to stop all caving not just SRB initiated caving.

5.7 RAFC Pan Pull Function

The rear AFC is left straight and one web back on the TG to MG cut. It is not snaked in until it starts to follow the high flow caving back to the TG.

5.8 Parameter Password Protection

A level of password protection for changing each parameter is recommended.

5.9 Water Sprays

The following is a list of water spray circuits that are required to be controlled by the PMC-R system.

Water curtain sprays on under side of canopy for dust suppression while flippers are activate. Controlled by PMC-R parameters. To include the following functionality:

- Can be initiated by Auto sequence and/or flipper activation. (Selectable through PMC-R parameters)
- Need the ability to select to turn on multiple adjacent shields either side of active shield.

Caving sprays for dust suppression while caving is occurring. Controlled by PMC-R parameters similar to Austar. To include the following functionality:

- Need the ability to select to turn on multiple adjacent shields either side of active caving shields as well as the active caving shields them selves.

Side seal sprays for dust suppression as shields lower, advance and set. Controlled by PMC-R parameters. To include the following functionality:

- Need to be able to turn the sprays on or off for each phase of shield advance. (i.e. lower, advance and set)
- Need the ability to select to turn on adjacent shields either side of active shield as well as the active shield itself.

Canopy tip sprays for dust suppression as shields lower, advance and set. Controlled by PMC-R parameters. To include the following functionality:

- Need to be able to turn the sprays on or off for each phase of shield advance. (i.e. lower, advance and set)
- Need the ability to select to turn on multiple adjacent shields either side of active shield as well as the active shield itself.

Lemniscate link sprays to stop accumulation of surface dust. Controlled by PMC-R parameters. To include the following functionality:
- Triggered by shields advance
- Need the ability to select to turn on multiple adjacent shields either side of active shield as well as the active shield itself.
- Need ability to select sprays coming on every shear or every second, third or fourth shear.

Pontoon sprays to stop accumulation of surface dust. Controlled by PMC-R parameters. To include the following functionality:
- Triggered by shields advance
- Need the ability to select to turn on multiple adjacent shields either side of active shield as well as the active shield itself.
- Need ability to select sprays coming on every shear or every second, third or fourth shear.

TG water curtain sprays to suppress dust before it travels off the face into the TG roadway. Controlled by PMC-R parameters. To include the following functionality:
- Sprays will only be active while ever the FAFC is running
- However sprays will have the ability to be de activated when the shearer is at the TG.

The PMC-R parameters for control of each of the water circuits need to be able to be customised for the direction the shearer is travelling. For example when cutting to the MG the size of the water curtain group may be 7 but it may only be 3 when cutting to the TG.

5.10 Additional Features Required 5.10.1 Cycle Count Software

Cycle count software is required for all hydraulic circuits that are activated by a DCV, controlled from a PMCR. These include:
- FAFC and RAFC chain tensioning systems.
- Boot hydraulic circuits
- Shield hydraulic circuits A visual interface package is required for operators to utilise the data in the cycle count data base for maintenance purposes. This interface package must as a minimum contain the 5 following functionality
- Two adjustable alarm levels on the accumulative cycle count of each circuit. One a warning that would alert the user that a circuit cycle count is approaching its limit and the next the alarm that it has reached its limit.
- A cycle rate alarm for each circuit. This would also be adjustable. This alarm would indicate to the user that there is something wrong with that circuit due to an increased number of cycle's per hour.
- Cycle rate data logging so that the normal cycle rate of each circuit can be established. Then the cycle rate alarms can be set from this data.
- Password protection for alarm level and cycle rate adjustable parameters. Also password protection for the resetting of cycle counts for each circuit.
- The cycle count for each circuit would need to have the ability to facilitate a cycle count for at least 3 different parts of the circuit.
  - Cycle count 1 might be for the staples and would be reset say every 50,000 cycles
  - Cycle count 2 might be for the hoses and would be reset say every 150,000 cycles
  - Cycle count 3 might be for a manifold and would be reset say every 500,000 cycles 5.10.2 Operator Proximity Detection An operator proximity protection system may be included as an option.

5.10.3 Unplanned Movement Protection

An unplanned movement protection system may be included as an option.

5.10.4 Button Press Record

PMC-R and shearer remote button press record function is required. This is to aid in the investigation of potential unplanned movements.

5.5 Shearer Special Requirements

The system is preferably provided with the ability to record the button presses on the hand held remote for the purpose of possible unplanned movement investigation.

An onboard Coal dust extractor is being developed for this shearer, the operational & engineering controls for this will be developed from Risk assessment process at both 10 Design & operational levels.

Table 1 below provides a concept of the proposed state based automation cut cycle for the shearer.

TABLE 1

Proposed cut cycle
Concept sate based automation cut cycle

| State | Name | Next | State start Shield No | State end Shield No | Direction | Speed | Transition command | Left drum mode | Right drum mode |
|---|---|---|---|---|---|---|---|---|---|
| 1 | TG stop to TG 70% web (Main cut TG -> MG) | 5 | 146 | 134 | Left | 14 | Position | Manual | Manual |
| 5 | TG 70% web to MG 100% web (Main cut TG -> MG) | 10 | 134 | 20 | Left | 12 | Position | Previous reference extraction | Current reference extraction |
| 10 | MG 100% web to MG slowdown (Main cut TG -> MG) | 15 | 20 | 8 | Left | 8 | Position | Previous reference extraction | Current reference extraction |
| 15 | MG slowdown (Main cut TG -> MG) | 20 | 8 | 7 | Left | 2 | Position | Previous reference extraction | Idle |

TABLE 1-continued

| Proposed cut cycle<br>Concept sate based automation cut cycle | | | | | | | | | |
|---|---|---|---|---|---|---|---|---|---|
| State | Name | Next | State start Shield No | State end Shield No | Direction | Speed | Transition command | Left drum mode | Right drum mode |
| 20 | MG stop (Main cut TG -> MG) | 25 | 7 | 7 | Left | 0 | Position | Manual | Idle |
| 25 | MG stop to MG clean stop (Clean) | 30 | 7 | 10 | Right | 14 | Position | Manual | Idle |
| 30 | MG clean stop (Clean) | 35 | 10 | 10 | Right | 0 | Position | Manual | Idle |
| 35 | MG clean stop to MG slowdown (Clean) | 40 | 10 | 8 | Left | 14 | Position | Manual | Idle |
| 40 | MG slowdown (Clean) | 45 | 8 | 7 | Left | 2 | Position | Manual | Idle |
| 45 | MG stop (Clean) | 50 | 7 | 7 | Left | 0 | Position | Manual | Idle |
| 45 | MG stop to MG 30% web (Main cut MG -> TG) | 50 | 7 | 19 | Right | 14 | Position | Manual | idle |
| 50 | MG 30% web to TG 100% web (Main cut MG -> TG) | 55 | 19 | 132 | Right | 14 | Position | Manual | Previous reference extraction |
| 55 | TG 100% web to TG slowdown (Main cut MG -> TG) | 60 | 132 | 145 | Right | 10 | Position | Manual | Previous reference extraction |
| 60 | TG slowdown (Main cut MG -> TG) | 65 | 145 | 146 | Right | 2 | Position | Idle | Previous reference extraction |
| 65 | TG stop (Main cut MG -> TG) | 70 | 146 | 146 | Right | 0 | Position | Idle | Manual |
| 70 | TG stop to TG clean stop (Clean) | 75 | 146 | 143 | Left | 14 | Position | Idle | Manual |
| 75 | TG clean stop (Clean) | 80 | 143 | 143 | Left | 0 | Position | Idle | Manual |
| 80 | TG clean stop to TG slowdown (Clean) | 85 | 143 | 145 | Right | 14 | Position | Idle | Manual |
| 85 | TG slowdown (clean) | 90 | 145 | 146 | Right | 2 | Position | Idle | Manual |
| 90 | TG stop (Clean) | 1 | 146 | 146 | Right | 0 | Position | Idle | Manual |

Notes:
Final Shield numbers can be varied, as required

1. Shield numbers instead of meters have been used to mark the start and end of each state as the exact measurements can not be confirmed until the design of the LTCC system has been finalised.
2. Slow downs will be triggered at a set distance before the electrical stop at each gate so that the machine will not travel past the stop point. This distance, and the set speed will be user defined. The slow down points in table 1 above will be shown as one shield from the electrical stops and the set speed for this area will be 2 m/min as the exact distance and speed need to be finalised.
3. Shearer has been allowed to come out of the gates 12 shields before it drums are taken out of manual control on the main cut runs. This can be eliminated if the recorded ranging arm height data from the clean up runs can be ignored for the purpose of arm automation.

4. Zoned extraction parameter in COMPACT when cutting right is 2.4 m from MG to shield 124, then 3.5 m from 132 to the TG.
5. Zoned extraction parameter in COMPACT when cutting left is 3.5 from TG to MG.
6. Machine position referred to is the centre of the machine in reference to the MG edge of the shield.
7. Shield numbers and meterages referred to are estimates and need to be confirmed once all equipment designed parameters are finalised.

The above described invention has been described by way of non-limiting example only and many modifications and variations may be made without departing from the spirit and scope of the invention.

LIST OF PARTS

1. Longwall top coal caving (LTCC) system
2. Extraction arm
3. Shield
4. Front panline
5. Rear panline
6. Rear canopy
7. Slide, door
8. Flipper
9. Longwall
10. Transition shield
11. End gate shield
12. Tail gate (TG)
13. Rear tail gate drive
14. Front tail gate drive
15. Shearer
16. Shearer arm
17. Cutter drum
18. Cutter drum
19. Ranging arm
20. Main gate (MG)
21.
22. Front main gate drive
23. Rear main gate drive
24. Buttress shield
25. Shield
26. Transition shield
27. Beam stage loader
28. Group
29.
30. Main canopy 30
31. Pontoon
32. Hydraulic legs
33. Roof
34. Mine
35. Face
36. Front conveyor
37. Rear conveyor
38. Hydraulic cylinder
39. Piston
40. Chain
1200. Controller
1210. Processor
1220. Memory
1230. Input device
1240. Output device
1250. Control Interface
1300. Control system
1310. Front tail gate sensor
1320. Rear tail gate sensor
1325. Front pan line and conveyor drive
1330. Front pan line and conveyor sensor
1335. Rear pan line and conveyor drive
1340. Rear pan line and conveyor sensor
1345. Shearer drive
1350. Shearer sensor
1355. Canopy drive(s)
1360. Canopy sensor
1365. Slide door drives(s)
1370. Slide door sensor(s)
1375. Flipper drive(s)
1380. Flipper sensor(s)
1385. Shield advancement drive(s)
1390. Shield advancement sensor(s)

The invention claimed is:

1. A method of operating a coal caving system which includes a plurality of shields, each with a rear canopy and a caving door, a front and rear conveyor extending beneath the shields, and a shearer to cut a web of coal along the front conveyor in a first and second pass, the method comprising operating the rear canopies in a first and second cycle associated with the first and second pass of the shearer and varying the volume of coal caving onto the rear conveyor during the second cycle, dependent upon the coal delivered to the front conveyor by the shearer during the first cycle.

2. The method of claim 1, wherein the caving doors are sequenced to only partially open in the first cycle, to allow caving onto the rear conveyor, responsive to a larger portion of the web being cut by the shearer during the first pass.

3. The method of claim 2, wherein groups of canopies are selectively fully opened during the second cycle to allow caving onto the conveyor.

4. The method of claim 3, wherein the coal caving during the second cycle supplements a reduced volume of coal cut during the second pass, in order to provide a more unified total output from both the first and second conveyors following the first and second passes of the shearer and associated caving cycles.

5. The method of claim 1, wherein the first and second cycles are sequenced so that the first cycle follows the first pass of the shearer and the second cycle leads the second pass of the shearer.

6. The method of claim 1, wherein the first cycle of coal caving is initiated from a tail gate end of the system and propagates toward a main gate, following the first pass of the shearer, while the second cycle propagates from the main gate and terminates back at the tail gate, ahead of the second pass of the shearer, whereby the coal caving remains downstream of an airflow established from the main gate to the tailgate.

7. A caving system, comprising:

a front and rear conveyor extending beneath shields which include canopies that are operable to allow caving onto the rear conveyor; and a controller configured to automatically open the canopies in a first and second cycle associated with a first and a second pass of a shearer to vary the volume of coal caving onto the rear conveyor during the second cycle, dependent upon the coal delivered to the front conveyor by the shearer during the first cycle.

8. A controller for a long wall top coal caving system that includes a shearer and a front and rear conveyor extending beneath shields which include rear canopies with caving doors, wherein the controller includes a processor configured to automatically open the canopies to allow caving onto the rear conveyor, wherein:

the processor is configured to compare a position of the shearer, based on sensor outputs, against one or more position thresholds, stored in memory of the controller, to determine if one or more of the canopies require opening in either a first or second cycle of coal caving;

the processor is configured to determine, based on the position of the shearer, if one or more of the open canopies need to be closed, wherein in response, the processor actuates a drive of the canopy to close the respective one or more canopies accordingly in order for the canopies to open and close a predetermined distance from the shearer position; and the processor is configured to open or close the canopies to vary the volume of coal caving onto the rear conveyor during the second cycle of coal caving, dependent upon the coal delivered to the front conveyor by the shearer during the first cycle of coal caving.

9. The controller of claim 8, configured to determine the number of canopies and opening times of the canopies during the first and second cycles of coal caving dependent on a volume of coal cut by the shearer and delivered to the front conveyor.

10. The controller of claim 8, configured to open and close the canopies behind the shearer in the first cycle of coal caving, when the shearer is cutting during the first pass, and ahead of the second pass of the shearer in the second cycle of coal caving.

* * * * *